US005219625A

United States Patent [19]

Matsunami et al.

[11] Patent Number: 5,219,625

[45] Date of Patent: Jun. 15, 1993

[54] THERMOCHROMIC LAMINATE MEMBER AND TOY UTILIZING THE SAME

[75] Inventors: Nobuaki Matsunami, Kakamigahara; Hiroshi Inagaki, Aichi, both of Japan

[73] Assignee: The Pilot Ink Co., Ltd., Nagoya, Japan

[21] Appl. No.: 908,350

[22] Filed: Jul. 6, 1992

[30] Foreign Application Priority Data

Jul. 9, 1991 [JP] Japan ..... 3-61723[U]
Nov. 22, 1991 [JP] Japan ..... 3-104115[U]

[51] Int. Cl.[5] ..... B44F 1/14

[52] U.S. Cl. ..... 428/30; 359/43; 359/44; 428/913

[58] Field of Search ..... 428/30, 913; 359/43, 359/44, 45, 53, 66, 68, 74

[56] References Cited

U.S. PATENT DOCUMENTS

| | | | |
|---|---|---|---|
| 4,162,343 | 7/1979 | Wilcox et al. | 428/30 |
| 4,681,791 | 7/1987 | Shibahashi et al. | 428/913 |
| 4,750,814 | 6/1988 | Suzuki | 359/44 |
| 5,164,741 | 11/1992 | Kaneko et al. | 359/43 |

*Primary Examiner*—William J. Van Balen
*Assistant Examiner*—Kathryne E. Shelborne
*Attorney, Agent, or Firm*—Fitzpatrick, Cella, Harper & Scinto

[57] ABSTRACT

A thermochromic laminate member comprises a thin transparent iridescent film laminated on a thermochromic layer 2, and exhibits rainbow-color pattern. The thermochromic layer shows reversible change between a first colored state and a second colored state by a temperature change.

4 Claims, 4 Drawing Sheets

THERMOCHROMIC LAMINATE MEMBER AND TOY UTILIZING THE SAME

BACKGROUND OF THE INVENTION

1. Field of the Invention

The present invention relates to a thermochromic chromic laminate member showing iridescent pattern and a toy utilizing the same.

2. Related Background Art

Thermochromic materials showing color changes between a colored state and a colorless state or a first colored state and a second colored state by a temperature change, and coloring articles utilizing such thermochromic material have already been well known, as disclosed in the U.S. Pat. Nos. 4,028,118 and 5,085,607, and have widely been utilized in various fields such as temperature detection, toys utilizing the advantage or unexpectedness of color change, and teaching aids.

SUMMARY OF THE INVENTION

The object of the present invention is to provide a thermochromic material which improves the effect of color variation in the above-mentioned conventional thermochromic materials, and enhances the decorative character, variety of color changes and effect and unexpectedness of color changes, thereby enabling application to various fields such as decoration, temperature indicators, toys and the like.

The present invention provides a thermochromic laminate member 1, comprising a thin transparent iridescent film 3 laminated on a thermochromic layer 2, and exhibiting rainbow-color pattern. It is also featured by a fact that the thermochromic layer 2 shows reversible change between a first colored state and a second colored state by a temperature change, and that a backcoat layer 5 of a color same as that of said first or second colored state is provided under said thermochromic layer 2. It is furthermore featured by a fact that the thin transparent iridescent layer 3 is formed in a plastic film itself, that a cloth 4 is adhered on the rear face of said film, and that the thermochromic layer 2 is by impregnation in said cloth.

The present invention also provides a toy utilizing said thermochromic laminate member 1.

In the following embodiments of the present invention will be explained with reference to the attached drawings.

Basic embodiments of the present invention include a configuration shown in FIG. 1 in which a thermochromic layer 2 is formed on a substrate 4 (transparent or opaque) and a thin transparent iridescent layer 3 is laminated on said thermochromic layer 2, a configuration shown in FIG. 2 in which the thermochromic layer 2 is laminated behind the thin transparent iridescent layer 3, and a configuration shown in FIG. 3 in which the thermochromic layer 2 is formed in the substrate 4 itself by blending the thermochromic material therein or impregnating the thermochromic material in a porous substrate.

In said configurations, a non-thermochromic layer may be provided under the thermochromic layer 2 for increasing the variety of color changes induced by the color change in the thermochromic layer 2.

The thermochromic layer 2 can be prepared with thermochromic materials including the already known temperature-sensitive color-varying materials such as liquid crystal, a three-component thermochromic material composed of an electron donating color-forming organic compound, an electron accepting compound and an organic medium capable of causing a reversible color-forming reaction between said compounds, or a thermochromic material containing fine particles of said components in the form of resinous solid solution, as disclosed, for example, in the U.S. Pat. Nos. 4,028,118 and 4,732,810. The above-mentioned materials exhibit color change at a certain temperature (color changing point), and only one of the states before and after the color change can exist at the normal temperature range. The other state can only be maintained during the application of heat or coldness required for obtaining said state, but the state at the normal temperature range is restored once the application of such heat or coldness is terminated. Such materials belong to a type of small hysteresis on color density—temperature.

The thermochromic layer may also be prepared with a thermochromic material showing large hysteresis in the color change, as disclosed in the U.S. Pat. No. 4,720,301. In such thermochromic material, the trajectory of color density change as a function of temperature is significantly different between the temperature elevation from a temperature below the color-changing temperature range and the temperature descent from a temperature above said range, and a varied state attained below the lower color-changing temperature or above the higher color-changing temperature can be memorized and retained in a normal temperature range between said color-changing temperatures.

The above-mentioned thermochromic material or color-memorizing thermochromic material is normally contained in microcapsules, which are dispersed in a medium containing binder and used in the form of ink or paint for forming a thermochromic layer on a substrate surface.

Said microcapsules may also be dispersed in thermoplastic or thermosetting resin.

Said thin transparent iridescent layer 3 can be composed of a known structure. More specifically it can be composed of a thin transparent film and a thin transparent film with surface irregularities, in which said thin transparent film can be composed of a thin metal compound film such as of titanium oxide, silicon oxide, zinc oxide, antimony oxide, zinc sulfide, magnesium fluoride or calcium fluoride; a thin film containing fine bubbles of gas generated by optical or thermal decomposition in thermoplastic resin composed for example of a copolymer of vinylidene chloride and vinyl chloride, vinyl acetate or vinyl alcohol or a copolymer of polyvinyl chloride, polyvinylidene chloride or polystyrene and vinyl chloride or styrene; a thin film composed of a composition consisting of vinylic copolymer, cellulose copolymer or urethane copolymer and a hardening agent or a hardening functional radical therefor, and an organo-substituted silicon compound; or a thin film composed of one of the above-mentioned organic materials and fine inorganic particles such as of titanium oxide, aluminum oxide or zirconium oxide. Also said surfacially irregular thin film has a difference in refractive index of at least 0.05 from that of the above-mentiond thin film and is colored or uncolored with a visible light transmittance of about 10%, or causes light scattering in or on the surface of the film, with a visible light transmittance of about 50%, as disclosed in the Japanese Patent Laid-open Application No. 61-227098. Said thin transparent iridescent film may be composed of a film showing optical interference pattern, provided on one or both faces thereof with an evaporated film of an oxide, a sulfide and/or a fluoride, as disclosed in the Japaense Patent Laid-open Application No. 60-32645, or a transparent multi-layered film showing optical interference and including 100 or more intermediate layers of two or more polymers of mutually different refractive indexes, as disclosed in the U.S. Pat. Re. No. 31,780 and exemplified by Mearl Iridescent Film (trade name) supplied by The Mearl Corporation, U.S.A.

On the rear face of said thin transparent iridescent layer 3 there may be directly provided the thermochromic layer 2, but practically the substrate 4 provided with the thermochromic layer 2 is adhered thereon.

Also onto the substrate 4, the thin transparent iridescent film 3 can be transferred and adhered by an iridescent transfer foil, consisting of a protective resin layer and a thin iridescent layer formed on a substrate sheet either directly or across a releasing layer, as disclosed in the Japanese Patent Laid-open Application No. 61-69499.

The substrate 4 can be composed of any material, for example a fibrous material such as cloth or non-woven cloth, a porous material such as paper or porous plastics, molded plastics, glass, ceramics or wood.

The configuration utilizing the combination of the thin iridescent layer 3 and the thermochromic layer 2 is not limited to those shown in FIGS. 1 to 3, but also includes, for example, a wavelike configuration shown in FIG. 4, a surfacially recessed configuration shown in FIG. 5, a configuration with locally positioned layer 3 as shown in FIG. 6, a configuration with suitably spaced plural thermochromic layers 2 and a back-coat layer 5 provided to cover the rear faces thereof and the spaces therebetween as shown in FIG. 7, a configuration in which the thermochromic layer 2 is formed in the impregnated state in the porous substrate 4 as shown in FIG. 8, and a configuration in which the thermochromic layer 2 is formed with suitable spaces in the impregnated state in the porous substrate 4 and the back-coat layer 5 is formed in the impregnated state in said porous substrate 4 and is further laminated at the back of said thermochromic layer 2, as shown in FIG. 9.

The coloring effect by the thin transparent iridescent layer 3 and the color change by temperature change in the thermochromic layer 2 are combined to demonstrate various rainbow-like color changes.

The perceived aspect changes in various manners depending on the background color (either the color of the thermochromic layer 2 or the color of the non-thermochromic layer observed in the color extinguished state of the thermochromic layer 2) underlying the thin transparent iridescent layer 3. If the background is black, the transmitted light is absorbed to emphasize the interference light, whereby the luster is intensified. On the other hand, if the background is white, the interference light vanishes by the light reflected from said white background. If the background is colored, the interference light and the light of the color of the background affect mutually, whereby the color is exhibited more vividly and various depending on the viewing angle.

The above-mentioned characteristics mutually affect with the color changes in the thermochromic layer 2, thus exhibiting various aspects.

Also in case the thermochromic layer 2 effects a change between a first colored state and a second colored state, there may be provided, under said thermochromic layer 2, a back-coat layer 5 of a color same as the color of said first or second colored state, thereby enabling to perceive an image in one of said colored states and forbidding the perception of said image in the other colored state.

DESCRIPTION OF THE PREFERRED EMBODIMENTS

Example 1

Figure 1:
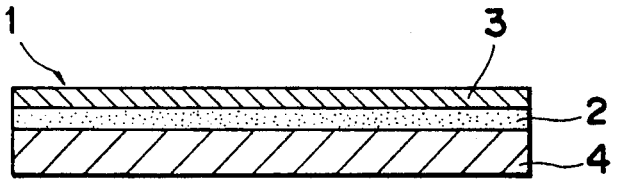
FIGS. 1 to 9 are magnified schematic cross-sectional views showing embodiments of the thermochromic laminate member of the present invention.
Figure 2:
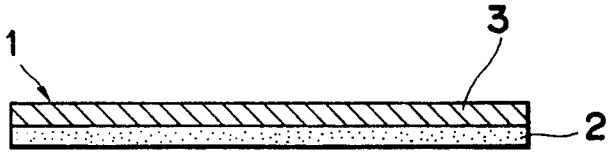
Figure 3:
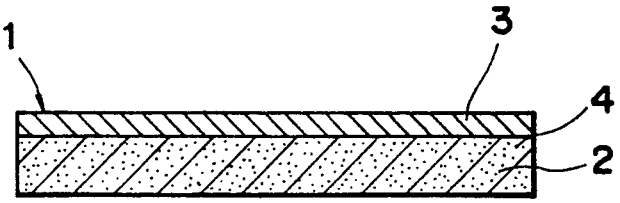
Figure 4:
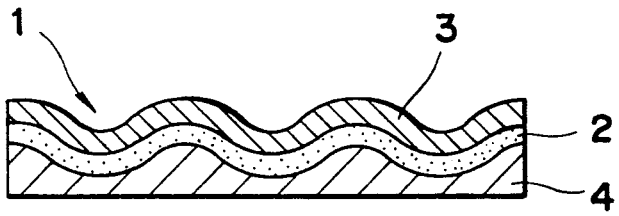
Figure 5:
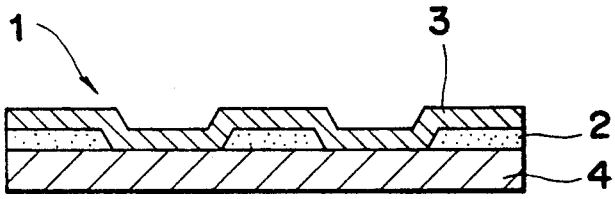
Figure 6:
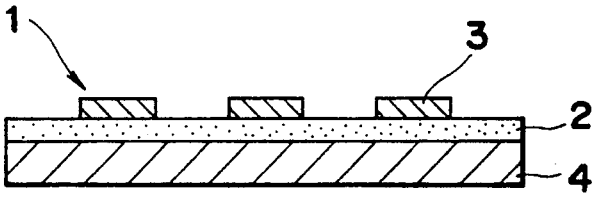
Figure 7:
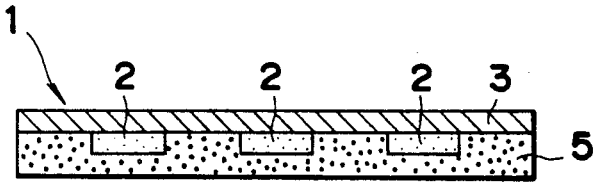
Figure 8:
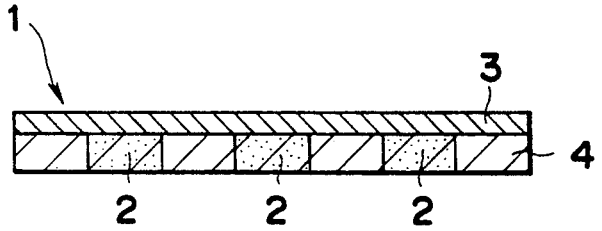
Figure 9:
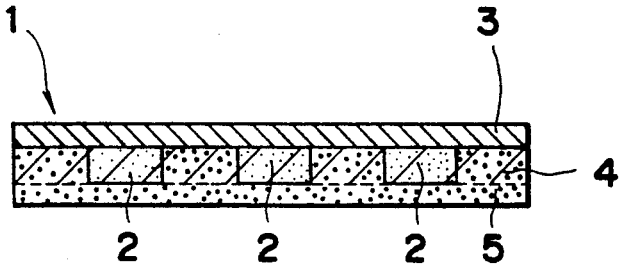
Figure 10:
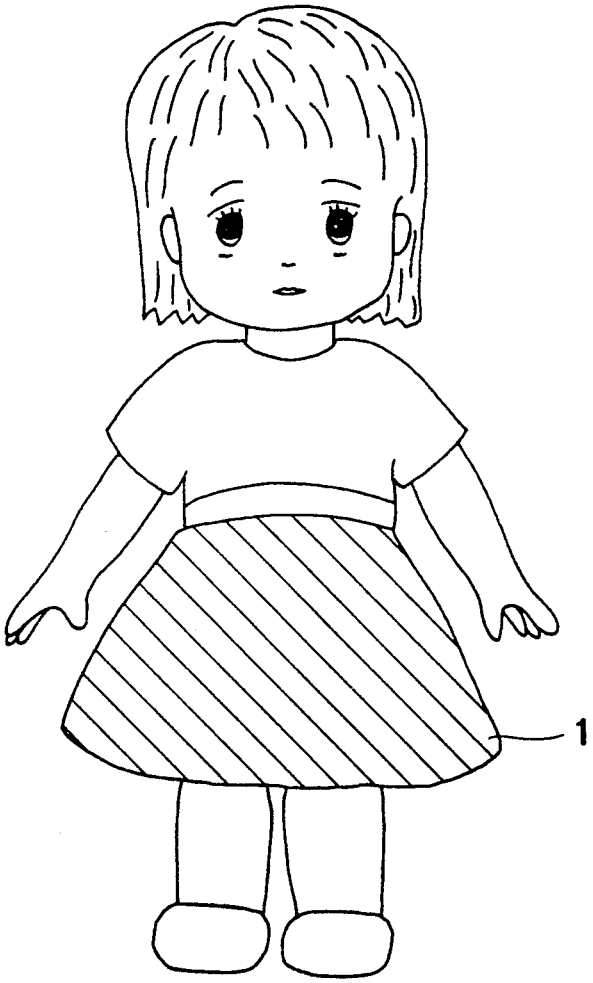
FIG. 10 is an external view of a doll utilizing the thermochromic laminate member of the present invention.

A thermochromic cotton cloth (showing color change from black to white at 30° C.) was prepared by screen printing, on cotton cloth, of a dispersion of 30 parts of a thermochromic pigment, showing color change from black to colorless at 30° C., in 70 parts of acrylic emulsion. Then a Mearl iridescent film (trade name IF-8101), having iridescent character by optical interference, was coated with acrylic resin emulsion and adhered to said thermochromic cotton cloth to obtain the thermochromic laminate member.

Said thermochromic laminate member showed opal luster, and was white or black respectively above and below 30° C. The parts in this and ensuing examples are represented by parts by weight.

Example 2

A polyester knit cloth was adhered, with a polyurethan adhesive, to a film same as in the example 1, and thermochromic ink similar to that in the example 1 was applied from the knit cloth side to obtain a knit cloth with opal luster, showing white or black color respectively above or below 30° C.

Example 3

On a nylon knit cloth adhered to a film in a similar manner as in the example 2, the thermochromic ink same as in the example 1 was screen printed in a pattern, from the side of said cloth. Then back-coating ink of the following composition was applied, by doctor coating, from the cloth side with a coating weight of 80 g/m$^2$.

Composition of Back-coating Ink 3 parts titanium oxide powder dispersion solid content 60%)
3 parts calcium carbonate powder
25 parts acrylic resin emulsion (solid content 50%)
69 parts terpene emulsion (terpene content 67%)
100 parts total

Example 4

15 parts of a thermochromic pigment, showing color change from blue to colorless at 15° C. and 0.7 parts of a fluorescent pink pigment were dispersed in 50 parts of epoxy resin to obtain epoxy ink showing pink color and purple color respectively above and below 15° C. 50 parts of said epoxy ink was mixed with 20 parts of an amine hardening agent, and the mixture was screen printed on urethane leather. Before hardening, an iridescent transfer film RB-6001 (trade name) supplied by Toyo Metallizing Co. was adhered, and the substrate film was peeled off after hardening to obtain synthetic urethane leather with Japanese lacquer luster, showing pink color or purple color respectively above or below 15° C.

Example 5

The synthetic urethane leather obtained in the example 4 was surfacially embossed to further enhance the luster.

Example 6

10 parts of a thermochromic color-memorizing pigment (red color developed at 15° C. and extinguished at 30° C.), 45 parts of 50% xylene solution of acrylic resin, 20 parts of xylene and 20 parts of methylisobutylketone were mixed under agitation and spray coated, with a spray gun, on a white polyvinyl chloride sheet to form a thermochromic layer 2 of a thickness of about 40 μm. Then the above-mentioned Mearl iridescent film, coated with acrylic resin emulsion, was adhered to obtain a thermochromic sheet.

Said thermochromic sheet showed red color at 15° C. or lower, and retained the red colored state in a temperature range below 30° C. At 30° C. or higher, the red color vanished and the white color of the background was exhibited, and retained in a temperature range of 15° C.-30° C.

The color change of the thermochromic layer 2 and the iridescent pattern were visually combined to realize various color changes.

In the following there will be explained examples of application of the thermochromic laminate member of the present invention to a toy doll.

Application Example 1

Preparation of a Doll Dress 20 parts of a thermochromic pigment, showing color change from blue to colorless at 30° C., and 2 parts of a fluorescent pink pigment were dispersed in 65 parts of acrylic resin emulsion, containing 3 parts of an epoxy crosslinking agent, to obtain thermochromic aqueous ink, showing color change from purple to pink at 30° C.

Then, on a nylon tricot cloth adhered to the Mearl iridescent film IF-8101 (trade name) having iridescent character by optical interference, said ink was applied by doctor coating from the cloth side, thereby obtaining a thermochromic fabric.

Said thermochromic fabric was employed for preparing a doll dress, which had iridescent pattern and showed color change from opal luster purple to pink by the body temperature. Thus there could be obtained a doll of special character. The parts in this example and ensuing examples are represented by parts by weight.

Application Example 2

Preparation of a Doll Dress

Dot patterns were printed on polyester lace cloth with the thermochromic ink of the example 1.

Then powder, obtained by cutting Mearl Iridescent Film IF-5121 (trade name) into the size of about 0.1-0.3 mm, was scattered on the printed surface and hardened, and the excessive powder was shaken off whereby a thermochromic fabric was obtained. A doll dress as in the application example 1 was prepared with said thermochromic fabric, and there could be obtained a doll with luster different from that of the application example 1.

Application Example 3

Preparation of a Doll Swimming Suit

On a nylon cloth, dued wave patterns were concealed by printing with thermochromic ink, which showed color change from black to colorless at 20° C., thereby obtaining a thermochromic nylon fabric.

The Rainbow Film RB-6001, a transfer film supplied by Toyo Metallizing Co., was adhered to said thermochromic nylon fabric with urethane emulsion, and, after hardening, the substrate film was peeled off to obtain a thermochromic nylon fabric which showed wave patterns above 15° C. and Japanese lacquer-like luster below 15° C. A swimming suit for a doll was prepared with this fabric and put on the doll. The swimming suit normally showed wave patterns, but, when put in water (below 15° C.), changed to Japanese lacquer-like luster color.

Application Example 4

A doll dress was prepared as in the application example 1 except that the thermochromic pigment therein was replaced by 30 parts of a thermochromic color-memorizing pigment (red color developed at 15° C. and extinguished at 30° C.).

Said dress exhibited purple color at 15° C. or lower, and retained this color below 30° C. It showed pink color at 30° C. or higher, and maintained this state in a temperature range of 15° C.-30° C. There were exhibited special color changes by the combination of color change of said thermochromic layer 2 and iridescent pattern.

Application Example 5

Preparation of a Stuffed Doll 5 parts of each of thermochromic pigments were dispersed in 95 parts of polyvinyl chloride sol (consisting of 50 parts of vinyl chloride resin, 45 parts of a plasticizer and 5 parts of a stabilizer) to obtain thermochromic polyvinyl chloride sol. The employed thermochromic pigments showed color changes of green-colorless, brown-colorless, and red-colorless at 30° C.

The above-mentioned thermochromic polyvinyl chloride sols were printed in succession in scale patterns on a knitted cloth, and heat treated for 1 minute at 150° C. Then said cloth was adhered to the Mearl Iridescent Film IF-5121 (trade name) and pressed with rollers of 180° C. to obtain a thermochromic synthetic leather.

Said synthetic leather was employed in the preparation of stuffed toys (alligator, fish etc.) which showed rainbow-colored luster and exhibited color changes by the body temperature.

Application Example 6

The thermochromic synthetic leather of the application example 5 was further embossed to form surface irregularities, whereby the luster was further enhanced. This synthetic leather was likewise utilized in the preparation of stuffed toys.

As explained in the foregoing, the laminate member of the present invention, based on the combination of a thermochromic material and a thin iridescent layer showing rainbow-colored patterns, is a novel and decorative thermochromic material which can fully exploit the characteristics of both materials and exhibit varied color changes resulting from the combination of both materials. It can therefore be applied to various fields such as toys, decorations, clothes and fiber materials.

What is claimed is:

1. A thermochromic laminate member comprising a thermochromic layer and a thin transparent iridescent layer laminated thereon.

2. A thermochromic laminate member according to claim 1, wherein said thermochromic layer is capable of reversible color change between a first colored state and a second colored state, and further comprising, under said thermochromic layer, a back-coat layer of a color same as the color of said first or second colored state.

3. A thermochromic laminate member according to claim 1, wherein said thin transparent iridescent layer is formed in a plastic film itself, on the rear face thereof adhered is a cloth.

4. A thermochromic laminate member according to claim 3, wherein said thermochromic layer is formed by impregnation in said cloth.

* * * * *

UNITED STATES PATENT AND TRADEMARK OFFICE

CERTIFICATE OF CORRECTION

PATENT NO. : 5,219,625

DATED : June 15, 1993

INVENTOR(S) : NOBUAKI MATSUNAMI, ET AL.

It is certified that error appears in the above-identified patent and that said Letters Patent is hereby corrected as shown below:

COLUMN 1

Line 8, "chromic" should be deleted.

COLUMN 4

Line 35, "than" should read --thane--.
Line 50, "solid" should read --(solid--.

COLUMN 6

Line 4, "dued" should read --dyed--.

COLUMN 8

Line 1, "color same" should read --same color--.
Line 5, "itself," should read --and a cloth is adhered-- and "thereof" should read --thereof.--.
Line 6, "adhered is a cloth." should be deleted.

Signed and Sealed this

Twenty-ninth Day of March, 1994

Bruce Lehman

*Attest:*

BRUCE LEHMAN

*Attesting Officer*

*Commissioner of Patents and Trademarks*